US012364327B1

(12) United States Patent
Zheng

(10) Patent No.: US 12,364,327 B1
(45) Date of Patent: Jul. 22, 2025

(54) MODULAR TABLE

(71) Applicant: ODK TECHNOLOGY PTE.LTD.

(72) Inventor: Hongbing Zheng, Hangzhou (CN)

(73) Assignee: ODK TECHNOLOGY PTE.LTD. (SG)

( * ) Notice: Subject to any disclaimer, the term of this patent is extended or adjusted under 35 U.S.C. 154(b) by 0 days.

(21) Appl. No.: 18/918,088

(22) Filed: Oct. 17, 2024

(30) Foreign Application Priority Data

Aug. 7, 2024 (CN) ..... 202421905649.3

(51) Int. Cl.
*A47B 13/08* (2006.01)
*A47B 13/02* (2006.01)

(52) U.S. Cl.
CPC ..... *A47B 13/088* (2013.01); *A47B 13/021* (2013.01); *A47B 2013/022* (2013.01)

(58) Field of Classification Search
CPC ..... A47B 13/088; A47B 13/02; A47B 13/021; A47B 2013/022
See application file for complete search history.

(56) References Cited

U.S. PATENT DOCUMENTS 4,338,867 A * 7/1982 Imber ..... A47B 13/02 248/188.91
6,000,343 A * 12/1999 Laney ..... A47B 87/002 108/65
6,427,604 B1 * 8/2002 Chrobak ..... A47B 9/00 108/157.16
10,045,609 B1 * 8/2018 Insua ..... A47G 1/0616
10,271,642 B1 * 4/2019 Lin ..... A47B 13/023
10,709,234 B1 * 7/2020 Brennan ..... A47B 41/02
10,806,247 B1 * 10/2020 Chen ..... A47B 3/0913
11,083,283 B1 * 8/2021 Shyu ..... A47B 13/003
11,564,487 B2 * 1/2023 Hsu ..... A47B 96/024
11,737,556 B1 * 8/2023 Saterbak ..... A47B 3/08 108/77
2014/0031149 A1 * 1/2014 Liao ..... A47B 13/003 473/496
2017/0164728 A1 * 6/2017 Chang ..... A47B 1/08
2017/0238696 A1 * 8/2017 Ehrreich ..... A47B 9/20
2024/0148135 A1 * 5/2024 Aube ..... A47B 9/18
2024/0251944 A1 * 8/2024 Zucca ..... A47B 77/022
2024/0398108 A1 * 12/2024 Zhang ..... A47B 13/088

* cited by examiner

*Primary Examiner* — Daniel J Rohrhoff
(74) *Attorney, Agent, or Firm* — IPRTOP LLC

(57) ABSTRACT

A modular table is provided. The modular table comprises a tabletop, a frame assembly, and a leg assembly. The tabletop comprises a first table board and a second table board. A first board edge of the first table board is spliced with a second board edge of the second table board, and a third board edge of the first table board is not spliced with the second table board. The frame assembly comprises a first supporting frame and a second supporting frame. A bottom of the first table board is fixed to the first supporting frame, a bottom of the second table board is fixed to the second supporting frame, and a first frame edge of the first supporting frame is connected with a second frame edge of the second supporting frame. The leg assembly comprises one or more supporting legs and one or more middle columns.

9 Claims, 2 Drawing Sheets

MODULAR TABLE

FIELD OF THE INVENTION

The present disclosure relates to furniture, and in particular, to a modular table.

BACKGROUND OF THE INVENTION

In modern home design, modular tables are gaining popularity for their versatility and flexibility. Traditional non-modular transportation often leads to tabletop breakage due to the large size. By using a modular structure, the packaging volume is reduced, significantly lowering this risk. Modular tables are perfect not only for home kitchens but also for patios, bars, and other diverse settings. Their designs typically feature elongated and narrow dimensions to fit various spatial layouts and usage needs.

However, while convenient, this design also presents some challenges. Firstly, the elongated and narrow dimensions make packaging and transporting modular tables bulky, increasing logistics costs and complexity. Secondly, the load-bearing capacity of modular tables is relatively weak due to size limitations. In actual use, especially when supporting heavy items, the tabletop tends to sag, affecting its stability and lifespan.

Existing modular tables often have complex structures, which not only increase manufacturing and maintenance difficulties but also make installation and operation cumbersome.

SUMMARY OF THE INVENTION

In view of the above-mentioned shortcomings, the present disclosure provides a modular table, which addresses the issues of large packaging volume and weak load-bearing capacity.

The modular table comprises a tabletop, a frame assembly, and a leg assembly. The tabletop comprises a first table board and a second table board. A first board edge of the first table board is spliced with a second board edge of the second table board, and a third board edge of the first table board is not spliced with the second table board. The frame assembly comprises a first supporting frame and a second supporting frame. A bottom of the first table board is fixed to the first supporting frame, a bottom of the second table board is fixed to the second supporting frame, and a first frame edge of the first supporting frame is connected with a second frame edge of the second supporting frame. The leg assembly comprises one or more supporting legs and one or more middle columns. One of the supporting legs is fixed to the bottom of the first table board near the third board edge, and one of the middle columns is fixed to the first frame edge and the second frame edge, respectively.

In one embodiment of the present disclosure, a fourth board edge of the second table board is not spliced with the first table board, and one of the supporting legs is fixed to the bottom of the second table board near the fourth board edge.

In one embodiment of the present disclosure, the modular table further comprises a third table board. A fifth board edge of the third table board is spliced with a fourth board edge of the second table board. A bottom of the third table board is fixed to a third supporting frame. A fifth frame edge of the third supporting frame is connected with a fourth frame edge of the second supporting frame, and one of the middle columns is fixed to the fifth frame edge and the fourth frame edge, respectively.

In one embodiment of the present disclosure, the first supporting frame comprises three supporting rods, and the supporting rods are connected to each other to form a first U-shaped structure. The first U-shaped structure has an opening facing the third board edge of the first table board.

In one embodiment of the present disclosure, each of the supporting legs comprises three supporting members, and the supporting members are connected to each other to form a second U-shaped structure. The second U-shaped structure has an opening facing away from the tabletop.

In one embodiment of the present disclosure, the first supporting frame and each supporting leg are the same in shape and dimensions.

In one embodiment of the present disclosure, the modular table further comprises one or more fixed rods. Two ends of each of the fixed rods are fixed to two supporting members of one of the supporting legs parallel to each other, respectively.

In one embodiment of the present disclosure, the modular table further comprises one or more cross beams. A first end of each of the cross beams is fixed to one of the fixed rods, and a second end of the cross beam is fixed to one of the middle columns.

In one embodiment of the present disclosure, the modular table further comprises one or more diagonal supporting members. A first end of each of the diagonal supporting members is fixed to one of the first and second supporting frames, and a second end of the diagonal supporting member is fixed to a corresponding supporting leg, forming a triangular supporting region enclosed by said diagonal supporting member, said supporting frame, and the corresponding supporting leg.

In one embodiment of the present disclosure, the first board edge is provided with mounting holes, the second board edge is provided with fixing holes, and each of the mounting holes corresponds to one of the fixing holes. A first end of each of columnar positioning pins is inserted into one of the fixing holes, and a second end of said columnar positioning pin is inserted into a corresponding mounting hole, to splice the first table board and the second table board together.

As described above, the disclosed modular table provides following technical advantages.

1. By using a splicing design on the sides of the first and second table boards and securing the corresponding supporting frames at the bottoms, along with the middle columns and supporting legs, the modular table of the present disclosure enhances the tabletop's load-bearing capacity, which prevents deformation or damage due to insufficient load-bearing capacity, ensuring the table's stability and durability over long-term use.
2. With the supporting leg installed on the fourth board edge of the second table board and the option to add a third table board, the modular table of the present disclosure allows the tabletop to be extended as needed. This design provides high flexibility and adaptability, making the table suitable for different space sizes and various usage scenarios.
3. The U-shaped supporting frame not only offers a larger load-bearing area and enhances the table's stability but also facilitates integrated production and installation. This structure simplifies the manufacturing process, reduces the number of parts and assembly complexity, thereby lowering production costs and assembly time. Additionally, the standardized design of the U-shaped supporting frame allows for mass production, improving production efficiency and making the final product easier and quicker to install.

4. Using columnar positioning pins to connect the table boards through mounting and fixing holes ensures a tight fit between the boards, and allows for easy installation and disassembly, improving the table's assembly efficiency and user experience.

REFERENCE NUMERALS

Figure 1:
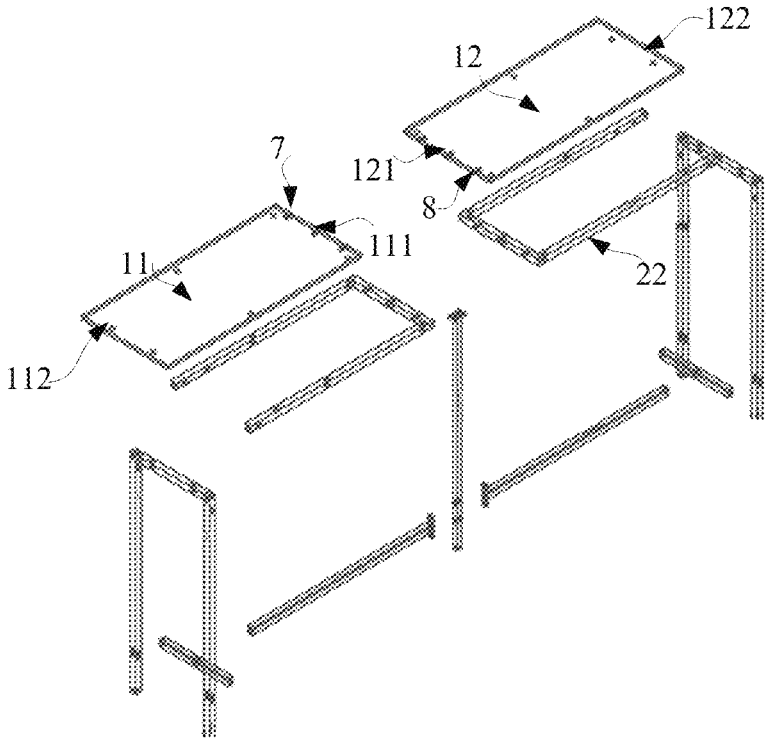
FIG. 1 is a schematic structural diagram of a modular table according to an embodiment of the present disclosure.

1 Tabletop
11 First table board
111 First board edge
112 Third board edge
12 Second table board
121 Second board edge
122 Fourth board edge
13 Third table board
131 Fifth board edge
2 Frame assembly
21 First supporting frame
211 First frame edge
212 Supporting rod
22 Second supporting frame
221 Second frame edge
222 Fourth frame edge
23 Third Supporting frame
231 Fifth frame edge
3 Leg assembly
31 Supporting leg
311 Supporting member
32 Middle column
4 Fixed rod
5 Cross beam
6 Diagonal supporting member
7 Mounting hole
8 Fixing hole

DETAILED DESCRIPTION OF THE INVENTION

The following describes the implementation of the present disclosure through specific examples, and those skilled in the art can easily understand other advantages and effects of the present disclosure from the content disclosed in this specification. The present disclosure can also be implemented or applied through other different specific embodiments. Various details in this specification can also be modified or changed based on different viewpoints and applications without departing from the spirit of the present disclosure. It should be noted that the following embodiments and the features in the embodiments can be combined with each other if no conflict will result.

Although not defined differently, all terms, including technical terms and scientific terms used herein, have the same meaning as generally understood by those skilled in the art to which this disclosure belongs. Terms defined in commonly used dictionaries are additionally interpreted as having meanings consistent with the contents of the present disclosure, and they should not be interpreted in an ideal or overly formulaic way unless so defined.

The present disclosure will be described in further detail below with reference to the accompanying drawings.

FIG. 1 shows an exploded view of a modular table in an embodiment of the present disclosure. The modular table comprises a tabletop 1, a frame assembly 2, and a leg assembly 3.

The tabletop 1 comprises a first table board 11 and a second table board 12. A first board edge 111 of the first table board 11 is spliced with a second board edge 121 of the second table board 12, and a third board edge 112 of the first table board 11 is not spliced with the second table board.

Specifically, the tabletop 1 comprises two independent table boards, the first table board 11 and the second table board 12, allowing the tabletop 1 to be expanded or adjusted based on spatial needs. The first table board 11 and the second table board 12 are spliced together by their board edges, specifically, the first board edge 111 of the first table board 11 aligns and connects with the second board edge 121 of the second table board 12, forming a continuous surface of the tabletop 1. The third board edge 112 of the first table board 11 is not (yet) spliced with any other table board, providing a possibility for further expanding the tabletop length.

In some embodiments, with reference to FIG. 1, the first board edge 111 is provided with mounting holes 7, the second board edge 121 is provided with fixing holes, and each of the mounting holes 7 corresponds to one of the fixing holes 8. A first end of each of columnar positioning pins is inserted into one of the fixing holes 8, and a second end of this columnar positioning pin is inserted into a corresponding mounting hole 7, to splice the first table board 11 and the second table board 12 together.

Specifically, the mounting holes 7 on the first board edge 111 and the fixing holes 8 on the second board edge 121 are arranged at a certain distance and corresponding relationship. The arrangement of these holes ensures precise alignment of the table boards during splicing, providing guidance for the insertion of the columnar positioning pins. The processing of the mounting holes 7 and the fixing holes 8 needs to be highly accurate to ensure that the columnar positioning pins can be smoothly inserted and that the table boards remain tightly fitted throughout the whole splicing process. The diameter, length and material of the columnar positioning pins can be adjusted based on the thickness of the table boards and the required connection strength.

During the splicing operation, it is first ensured that the first board edge 111 of the first table board 11 and the second board edge 121 of the second table board 12 are aligned. Then, the first end of one columnar positioning pin is aligned with one of the fixing holes 8, and the second end of this columnar positioning pin is aligned with the corresponding mounting hole 7, and this columnar positioning pin is then gradually pushed into the holes until it is fully inserted, securely connecting the two table boards together.

The use of columnar positioning pins allows for a reversible connection of the table boards, making it easy to disassemble and reassemble the table. Additionally, the position and number of the columnar positioning pins can be adjusted as needed to accommodate different splicing lengths or table board widths.

Figure 2:
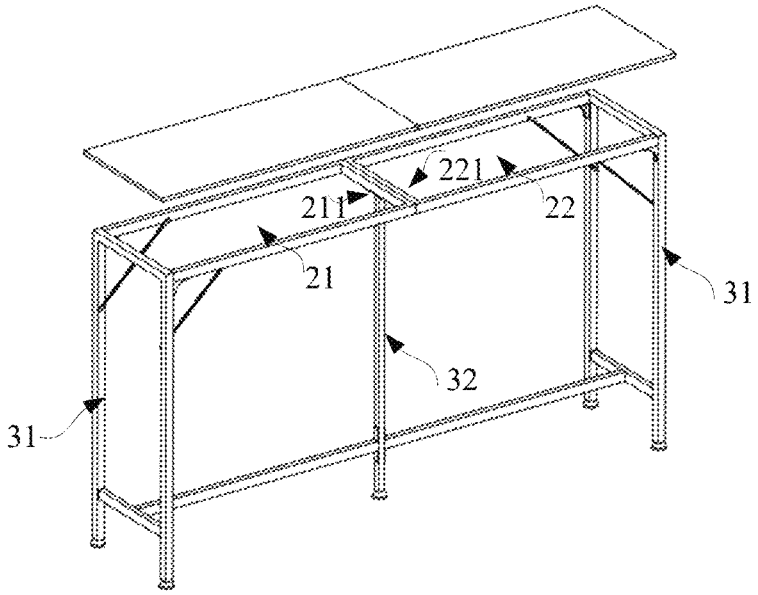
FIG. 2 is a schematic structural diagram of a frame assembly of the modular table according to the embodiment of the present disclosure.

As shown in FIG. 2, the frame assembly 2 comprises a first supporting frame 21 and a second supporting frame 22. A bottom of the first table board 11 is fixed to the first supporting frame 21, a bottom of the second table board 12 is fixed to the second supporting frame 22, and a first frame edge 211 of the first supporting frame 21 is connected with a second frame edge 221 of the second supporting frame 22.

The connection between the first supporting frame 21 and the bottom of the first table board 11, as well as between the second supporting frame 22 and the bottom of the second table board 12, can be achieved using various methods such as screws, bolts, clamps, or adhesives, ensuring a secure attachment between the table boards and the supporting frames. The connection between the first frame edge 211 of the first supporting frame 21 and the second frame edge 221 of the second supporting frame 22 can be direct or facilitated through connectors or fasteners, ensuing stability and smoothness at the connection points.

The supporting frames can be made from metal, plastic, wood, or other high-strength materials, chosen based on the required load-bearing capacity and aesthetic design. The design of the supporting frames should consider their structural strength and durability. The dimensions of the supporting frames should match those of the table boards to ensure the frames can fully support the bottoms of the table boards, providing sufficient support area. Additionally, the surface of the supporting frames can be treated with spraying, electroplating, oxidation, or coating to enhance their corrosion resistance, wear resistance, and appearance.

Figure 3:
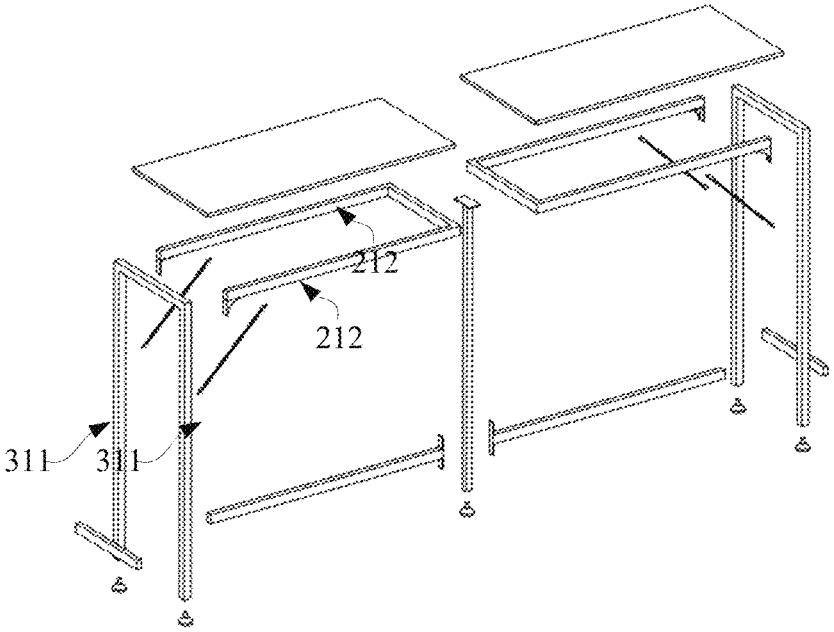
FIG. 3 is a schematic structural diagram of a modular table according to another embodiment of the present disclosure.

In some embodiments, as shown in FIG. 3, the first supporting frame 21 comprises three supporting rods 212, and the supporting rods are connected to each other to form a first U-shaped structure. The first U-shaped structure has an opening facing the third board edge 112 of the first table board 11.

The first U-shaped structure formed by the three interconnected supporting rods provides stability and offers an open support design, allowing for more flexible space layout under the table boards. The first U-shaped structure consists of two side supporting rods and one bottom supporting rod, with the side supporting rods perpendicular to the bottom supporting rod. The opening of the first U-shaped structure faces the third board edge 112 of the first table board 11, allows the supporting frames to fit closely to edges of the table boards while leaving space at the third board edge 112, which can be used for additional support or as legroom under the table boards. The three supporting rods can be connected through welding, bolting, riveting, or using specialized connectors to form a sturdy U-shaped structure. As an example, the first U-shaped structure is formed in one-piece.

Referring to FIG. 2, the leg assembly 3 comprises one or more supporting legs 31 and one or more middle columns 32. One of the supporting legs 31 is fixed to the bottom of the first table board 11 near the third board edge 112, and one of the middle columns 32 is fixed to the first frame edge 211 and the second frame edge 221, respectively.

The leg assembly 3, including the supporting legs 31 and the middle columns 32, provides vertical support and stability for the table. As an example, one of the supporting legs 31 is fixed to the bottom of the first table board 11 near the third board edge 112; and the placement and number of the supporting legs 31 depend on the size, shape, and load-bearing requirements of the tabletop. As an example, one of the middle columns 32 is fixed to the first frame edge 211 and the second frame edge 221, respectively; and the middle columns 32 typically extends vertically from the tabletop to provide extra support and stability.

Additionally, the supporting legs 31 and the middle columns 32 can be made from metal, wood, plastic, or other high-strength materials to ensure sufficient load-bearing capacity and durability. Surfaces of the supporting legs 31 and the middle columns 32 can be treated with spraying, electroplating, oxidation, or coating to enhance their corrosion resistance, wear resistance, and appearance.

In some embodiments, a fourth board edge 122 of the second table board 12 is not spliced with any other table board, and one of the supporting legs 31 is fixed to the bottom of the second table board 12 near the fourth board edge 122.

The unspliced design of the fourth board edge 122 makes it easier to install the supporting leg 31 in the bottom area near this edge, and provides an additional support point on this side of the table, enhancing the overall stability of the structure. The connection between the supporting leg 31 and the bottom of the second table board 12 can be achieved through direct welding, bolting, clamping, or using specialized connectors, ensuring a secure attachment. The supporting leg 31 installed near the fourth board edge 122 of the second table board 12 provides an extra support point, helping to distribute the load on the tabletop, which is particularly beneficial for longer tabletops or those bearing heavier items, significantly improving the table's load-bearing capacity and stability.

Referring to FIG. 3, each of the supporting legs 31 comprises three supporting members 311, and the supporting members 311 are connected to each other to form a second U-shaped structure. As an example, the second U-shaped structure is formed in one-piece. The second U-shaped structure has an opening facing away from the tabletop.

Specifically, the three supporting members 311 form a unified U-shaped structure through welding, bolting, riveting, or other mechanical connection methods. The opening of the second U-shaped structure faces away from the tabletop, providing more space between the supporting legs and the tabletop, allowing for better legroom and increased comfort for users. The supporting members 311 can be made from metal, wood, plastic, or other high-strength materials to ensure sufficient strength and durability to support the tabletop. The U-shaped supporting leg 31 being fixed to the bottom of the second table board 12 helps support the tabletop while maintaining its stability.

To achieve standardized production and improve efficiency, in some embodiments, the first supporting frame 21 and the supporting legs 31 are the same in shape and dimensions.

When the supporting frames and the supporting legs are designed to have the same shape and dimensions, they can be interchangeable in some cases, providing greater flexibility for the assembly and maintenance of the table structure. The universality of the components simplifies inventory management, reducing the need to store components of different shapes and dimensions separately, thereby lowering inventory costs. Consistency in shape and dimensions may also mean that the supporting frames and supporting legs use the same connection methods or fasteners, further simplifying the assembly process and reducing the variety of tools and parts needed.

Figure 4:
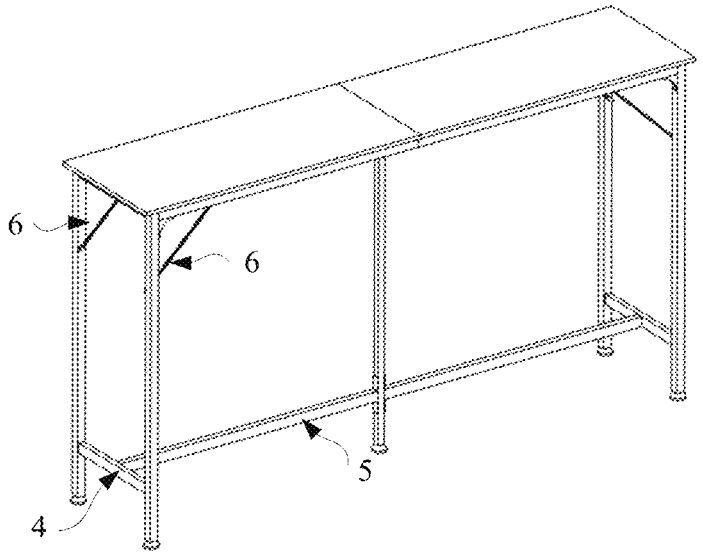
FIG. 4 is a schematic structural diagram of a modular table according to yet another embodiment of the present disclosure.

In some embodiments, to enhance the overall stability and load-bearing capacity of the modular table, as shown in FIG. 4, the modular table further comprises one or more fixed rods 4. Two ends of each of the fixed rods 4 are fixed to two supporting members 311 of one of the supporting legs 31 parallel to each other, respectively.

The connection between the two ends of the fixed rod 4 and the supporting members 311 can be achieved through welding, bolting, riveting, or using specialized connectors. The main function of the fixed rods 4 is to provide lateral support by connecting the two supporting members 311, limiting the lateral movement of the supporting legs 31 and increasing the stability of table legs.

Furthermore, as shown in FIG. 4, the modular table further comprises one or more cross beams 5. A first end of each of the cross beams 5 is fixed to one of the fixed rods 4, and a second end of the cross beam is fixed to one of the middle columns.

The main function of the cross beams 5 is to provide additional lateral support. The cross beams 5 work together with the fixed rods 4 and the middle columns 32 to form a sturdy frame, enhancing the table's stability and durability. The cross beams 5 can be made from the same materials as the leg assembly 3, such as metal, wood, or high-strength plastic, to ensure consistency and strength throughout the leg assembly 3.

In some embodiments, with reference to FIG. 4, the modular table further comprises one or more diagonal supporting members 6. A first end of each of the diagonal supporting members 6 is fixed to one of the first and second supporting frames, and a second end of the diagonal supporting member is fixed to a corresponding supporting leg, forming a triangular supporting region enclosed by said diagonal supporting member, said supporting frame, and the corresponding supporting leg.

In one embodiment, one of the diagonal supporting members 6 is positioned between the first supporting frame 21 and the supporting leg 31 on the same side, creating a diagonal connection that strengthens the table's support structure. The main function of the diagonal supporting member 6 is to form the triangular supporting region, utilizing the stability principle of a triangle to enhance the table's resistance to bending and twisting. The length, width, and thickness of the diagonal supporting members 6 can be adjusted based on the table's size and load-bearing requirements.

To accommodate the need for more workspace, in some embodiments, the modular table further comprises a third table board 13. A fifth board edge 131 of the third table board 13 is spliced with a fourth board edge 122 of the second table board 12. A bottom of the third table board 13 is fixed to a third supporting frame 23. A fifth frame edge 231 of the third supporting frame 23 is connected with a fourth frame edge 222 of the second supporting frame 22, and one of the middle columns 32 is fixed to the fifth frame edge 231 and the fourth frame edge 222, respectively.

Specifically, the tabletop of the modular table can be expanded further by adding the third table board, allowing the tabletop to cover a larger area, and meeting a wider range of needs. The third table board 13 is spliced with the fourth board edge 122 of the second table board 12 via its fifth board edge 131. The third supporting frame 23 fixed with the bottom of the third table board 13 provides the necessary structural support for the third table board 13, ensuring the table's stability and load-bearing capacity. The connection between the fifth frame edge 231 and the fourth frame edge 222 ensures the overall supporting frame is coherent and consistent, providing uniform support for the table boards.

To support this expansion, one of the middle columns 32 is fixed to the fifth frame edge 231 and the fourth frame edge 222, respectively, ensuring the table's stability and load-bearing capacity in the longitudinal direction, further allowing the tabletop to remain sturdy and stable even after expansion, meeting the needs for a larger usage area.

In summary, the modular table of the present disclosure creates a continuous work surface by joining the board edges of the table boards. The first supporting frame 21 and the second supporting frame 22 are disposed below the table boards to offer a stable foundation, and the middle columns 32 enhance table's overall stability. The supporting legs have a U-shaped design, matching the shape and dimensions of the supporting frames, which simplifies production and increases component versatility. The leg assembly comprises additional fixed rods and cross beams, forming a reinforced structure that boosts the table's load-bearing capacity. The introduction of the diagonal supporting members further creates triangular supporting regions between the supporting frames and the supporting legs. Additionally, the quick splicing of the table boards is achieved through the alignment of mounting holes and fixing holes with columnar positioning pins, simplifying the assembly process.

The above-mentioned embodiments are merely illustrative of the principle and effects of the present disclosure instead of limiting the present disclosure. Those skilled in the art can make modifications or changes to the above-mentioned embodiments without going against the spirit and the range of the present disclosure. Therefore, all equivalent modifications or changes made by those who have common knowledge in the art without departing from the spirit and technical concept disclosed by the present disclosure shall be still covered by the claims of the present disclosure.

The invention claimed is:

1. A modular table, comprising:

a tabletop, comprising a first table board and a second table board, wherein a first board edge of the first table board is spliced with a second board edge of the second table board, and a third board edge of the first table board is not spliced with the second table board;

a frame assembly, comprising a first supporting frame and a second supporting frame, wherein a bottom of the first table board is fixed to the first supporting frame, a bottom of the second table board is fixed to the second supporting frame, and a first frame edge of the first supporting frame is connected with a second frame edge of the second supporting frame; and a leg assembly, comprising one or more supporting legs and one or more middle columns, wherein one of the supporting legs is fixed to the bottom of the first table board near the third board edge, and one of the middle columns is fixed to the first frame edge and the second frame edge, respectively;

wherein the first supporting frame comprises three supporting rods, and the supporting rods are connected to each other to form a first U-shaped structure, wherein the first U-shaped structure has an opening facing the third board edge of the first table board;

wherein each of the supporting legs comprises three supporting members, and the supporting members are connected to each other to form a second U-shaped structure, wherein the second U-shaped structure has an opening facing away from the tabletop;

wherein the first U-shaped structure and the second U-shaped structure are connected by diagonal supporting members.

2. The modular table according to claim 1, wherein a fourth board edge of the second table board is not spliced with the first table board, and one of the supporting legs is fixed to the bottom of the second table board near the fourth board edge.

3. The modular table according to claim 1, wherein the first supporting frame and each supporting leg are the same in shape and dimensions.

4. The modular table according to claim 1, further comprising one or more fixed rods, wherein two ends of each of the fixed rods are fixed to two supporting members of one of the supporting legs parallel to each other, respectively.

5. The modular table according to claim 4, further comprising one or more cross beams, wherein a first end of each of the cross beams is fixed to one of the fixed rods, and a second end of the cross beam is fixed to one of the middle columns.

6. The modular table according to claim 1, wherein a first end of each of the diagonal supporting members is fixed to one of the first and second supporting frames, and a second end of the diagonal supporting member is fixed to a corresponding supporting leg, forming a triangular supporting region enclosed by said diagonal supporting member, said supporting frame, and the corresponding supporting leg.

7. The modular table according to claim 1, wherein the first board edge is provided with mounting holes, the second board edge is provided with fixing holes, and each of the mounting holes corresponds to one of the fixing holes.

8. The modular table according to claim 1, wherein the first U-shaped structure is formed in one-piece, and the second U-shaped structure is formed in one-piece.

9. The modular table according to claim 1, wherein the first U-shaped structure and the second U-shaped structure are hollow.

* * * * *